US006175978B1

(12) United States Patent
Nizzi et al.

(10) Patent No.: US 6,175,978 B1
(45) Date of Patent: Jan. 23, 2001

(54) INFLATABLE DISPOSABLE COVERED PILLOW

(75) Inventors: Marsha Nizzi, 4216 Rosser Sq., Dallas, TX (US) 75244; Anne R. Freiermuth, 305 Fanmar Way, Capitol, CA (US) 95010

(73) Assignees: Marsha Nizzi; Anne R. Freiermuth, both of Paradise, CA (US)

( * ) Notice: Under 35 U.S.C. 154(b), the term of this patent shall be extended for 0 days.

(21) Appl. No.: 09/253,807

(22) Filed: Feb. 19, 1999

(51) Int. Cl.[7] ..... A47G 9/00; A47C 27/08

(52) U.S. Cl. ..... 5/644; 5/636; 5/655.3; 5/490

(58) Field of Search ..... 5/644, 636, 640, 5/654, 655.3, 490

(56) References Cited

U.S. PATENT DOCUMENTS

| | | | | |
|---|---|---|---|---|
| Re. 17,057 | * | 7/1928 | Voit | 5/655.3 X |
| D. 316,227 | | 4/1991 | Gentes et al. | D9/415 |
| D. 347,789 | | 6/1994 | Kaplan | D9/305 |
| 1,644,096 | * | 10/1927 | Voit | 5/655.3 X |
| 3,638,253 | | 2/1972 | Stumpf | 5/337 |
| 4,200,942 | * | 5/1980 | Case | 5/655.3 |
| 4,277,859 | | 7/1981 | Seaman | 5/434 |
| 4,932,089 | * | 6/1990 | Laviero | 5/644 X |
| 5,012,539 | * | 5/1991 | Grigg | 5/644 |
| 5,231,720 | * | 8/1993 | Benoff | 5/644 |
| 5,317,772 | * | 6/1994 | Perl et al. | 5/644 |
| 5,432,967 | * | 7/1995 | Raffery | 5/644 X |
| 5,524,308 | * | 6/1996 | Hwang et al. | 5/490 X |
| 5,544,378 | | 8/1996 | Chow | 5/644 |
| 5,557,815 | * | 9/1996 | Mintz et al. | 5/490 X |
| 5,645,319 | | 7/1997 | Parks, Jr. | 297/391 |

* cited by examiner

*Primary Examiner*—Terry Lee Melius
*Assistant Examiner*—Robert G. Santos
(74) *Attorney, Agent, or Firm*—Donald E. Schreiber

(57) ABSTRACT

An inflatable, disposable covered pillow which can be conveniently carried and stowed by a user in a deflated state, and used as a comfortable, clean pillow in an inflated state. The inflatable pillow includes an inflatable airtight chamber sandwiched between first and second fabric sheets in one embodiment, and surrounded by a fabric sleeve in another. The airtight chamber and first and second fabric sheets, or the fabric sleeve, are joined by a seam to the airtight chamber. One of the fabric sheets may include an adhesive securing tab to facilitate wrapping the fabric sheets around the airtight chamber and keeping the fabric sheets in place. The inflatable pillow may also include a sanitary sheet, joined to the inflatable pillow along the seam. The sanitary sheet provides a cover for the pillow in a deflated state, and helps to keep the pillow clean by insulating the pillow from a seat, window, or other items upon which a user may place a pillow.

11 Claims, 2 Drawing Sheets

INFLATABLE DISPOSABLE COVERED PILLOW

BACKGROUND OF THE INVENTION

1. Field of the Invention

The present invention relates generally to pillows, and more particularly to pillows which are suitable for use while traveling and which can be conveniently carried and stowed when not in use. In particular, the invention relates to an inflatable pillow which is covered for both comfort and sanitary purposes, and which is disposable.

2. Introduction to the Invention

In an attempt to reduce travel time and avoid long delays in airports and other terminals, more and more passengers are hand carrying more and more luggage and personal items onto airplanes and other carriers, and are trying to squeeze the luggage and personal items into less and less space available in the passenger compartment. As a result, carriers have recently instituted programs to severely limit the size and number of hand-carried items which each passenger may carry on-board.

Moreover, whereas comfort items such as pillows, blankets and related items used to be plentiful and widely available for all on board, presently such items are commonly in scarce supply, especially in coach or economy class. Storage space previously allocated to items such as pillows and blankets has been usurped to hold baggage and other items carried on by passengers.

Even when items such as blankets and pillows are available, passengers may have concerns about the cleanliness of such items. With airplanes commonly turned around quickly between flights, it may not be practicable to assure that such items, especially pillows and pillow covers, are properly replaced with clean items.

Pillows large enough to be comfortable are commonly too large and bulky to be conveniently carried on board aircraft. Alternatively, passengers who may wish to carry their own pillows on-board are therefore limited in what other personal items and luggage they may otherwise carry.

There is therefore a need for a pillow which is suitable for use by passengers on airplanes and other vehicles, which pillow may be conveniently carried on-board by passengers and take up minimal space when not in use. Similarly, a need in hospitals or shelters, or analogous locations during emergencies such as after a natural disaster, for a disposable pillow that stores compactly prior to use. Such a pillow should be comfortable to use and should be pleasant to contact with the skin on the face and head. Such a pillow should provide a clean interface to the user. Such a pillow should be inexpensive so that, if desired, the pillow may be disposed of after even only one use.

SUMMARY OF THE INVENTION

We have invented an inflatable, disposable, covered pillow which is suitable for use by passengers on airplanes and other vehicles. The inflatable pillow of the invention is both comfortable and clean, and is inexpensive so that it may be disposed of, even after only one use. In a deflated state, the inflatable pillow of the invention may be conveniently carried or stowed in a minimal space.

In a first aspect, the invention provides an inflatable pillow comprising a first fabric sheet, a second fabric sheet, and an inflatable airtight chamber sandwiched between the first and second fabric sheets. The inflatable airtight chamber is joined to the first and second fabric sheets at a seam along a first edge of each of the inflatable airtight chamber, the first fabric sheet and the second fabric sheet. The inflatable airtight chamber has a inflation assembly for regulating inflation and deflation of the inflatable airtight chamber, and the first and second fabric sheets configured to wrap around and cover substantially all of the inflatable airtight chamber when the inflatable airtight chamber is substantially inflated.

In preferred embodiments, the fabric sheets may be made of a cloth, textile, paper or other sheet material which is suitable for use as a pillow case.

In a preferred embodiment, an inflatable pillow according to the invention includes means to secure the first fabric sheet to the second fabric sheet at a point located along an edge that is opposite the respective first edges of each of the first and second fabric sheets. The securing means is used to join the first fabric sheet and second fabric sheet at respective second edges in order to provide a comfortable fabric cover around the airtight chamber. The securing means may be an adhesive tab or other suitable fastener, e.g. clasps, clamps, pins, and the like. However, an adhesive tab is preferred since such a tab can be integrated with the pillow assembly. Also, other means, e.g. metal fasteners, could cause discomfort on contact or have a tendency to scratch the user.

In a preferred embodiment, an inflatable pillow according to the invention includes a sanitary sheet joined to the sandwich of the first and second fabric sheets and inflatable airtight chamber. The sanitary sheet is outside either the first or second fabric sheet, and a first edge of the sanitary sheet is joined to the sandwich along the seam. The sanitary sheet may provide a cover for the pillow in an inflated state, for example by insulating the inflatable pillow from a seat, window, or other items upon which a user may place a pillow. The sanitary sheet may also serve as a protective cover for the inflatable pillow in a deflated state in which the inflatable pillow may be folded, rolled, or the like for shipping, for carrying by a user, or for storage.

In another embodiment of the present invention, a one-piece, hollow fabric sleeve, which encircles the airtight chamber, replaces the first and second fabric sheets.

These and other features, objects and advantages will be understood or apparent to those of ordinary skill in the art from the following detailed description of the preferred embodiments as illustrated in the various drawing figures in which elements depicted in more than one FIG. carry a common reference numeral in each FIG. Neither of the FIGS. are to scale.

DETAILED DESCRIPTION

Figure 1:
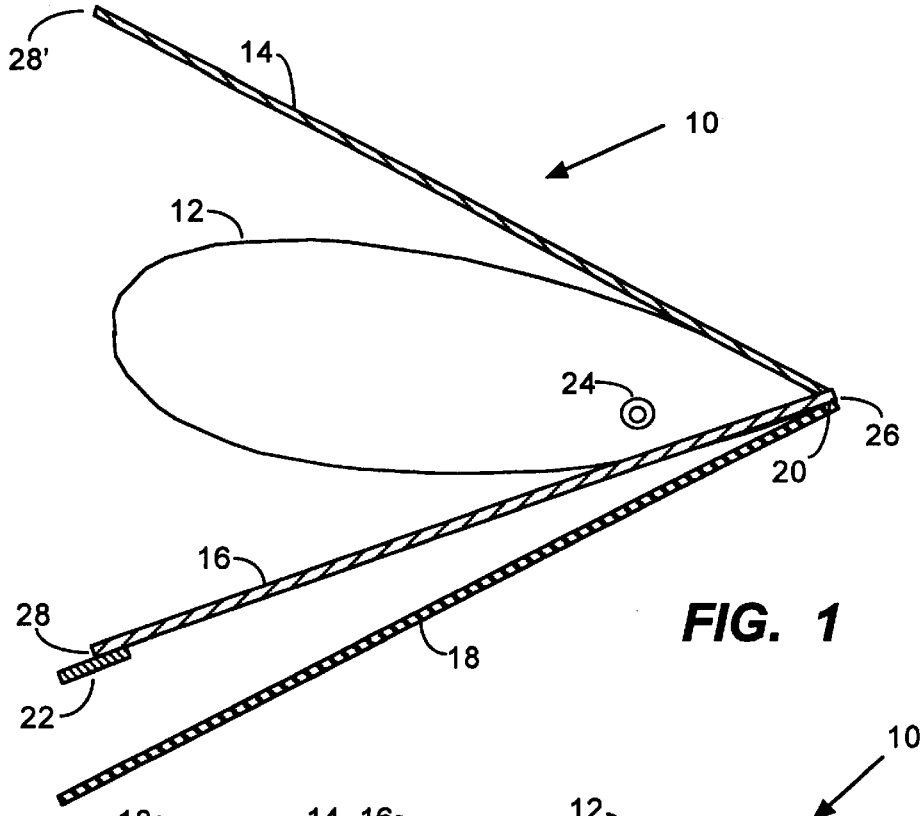
FIG. 1 is a side view of one embodiment of an inflatable pillow according to the invention.

FIG. 1 is a side view of an embodiment of an inflatable pillow 10 according to a first aspect of the invention. The inflatable pillow 10 includes an inflatable airtight chamber 12.

The airtight chamber 12 may be made of a plastic or any other material suitable for such use known to those of ordinary skill in the art. The invention contemplates that various thicknesses and strengths of such material may be used depending on the anticipated usage of the inflatable pillow 10. Thus, in an inflatable pillow 10 intended to be used only once, the airtight chamber 12 may be made of a lighter and thinner material than would be used for an airtight chamber 12 in an inflatable pillow which is intended for multiple or extended use, or in circumstances which might require greater resistance, e.g. heavy user, bumpy travel conditions, etc.

As illustrated in FIG. 1, the airtight chamber 12 is in a substantially inflated state.

Moreover, although not illustrated in any of the FIGS. herein, it is understood that an airtight chamber may be formed of one or more sheets of suitable material which are joined together by means known to those of ordinary skill in the art.

The airtight chamber 12 has a inflation assembly 24 to regulate inflation and deflation of the airtight chamber 12. The inflation assembly 24 may be located in any convenient location on the airtight chamber 12, however, it is preferred that the inflation assembly 24 not be located where the inflation assembly 24 would interfere with the comfort of a person resting on the inflatable pillow 10. A preferred embodiment of a inflation assembly 24 will be described below to reference to FIG. 3.

The airtight chamber 12 is sandwiched between first and second fabric sheets 14, 16. The airtight chamber 12, the first fabric sheet 14, and the second fabric sheet 16 are all joined by a seam 20 formed along a first edge 26 of each of the airtight chamber 12, the first fabric sheet 14 and the second fabric sheet 16. The seam 20 may be formed by a heat sealing process, by adhesive, by stitching, or by any other suitable process known to those of ordinary skill in the art.

The first and second fabric sheets 14, 16 are made of fabric which is suitable for use as a pillow case and which makes a pleasant contact with the skin on the face and head. The first and second fabric sheets 14, 16 may be white or a color, and may include designs, patterns, and the like.

Figure 2:
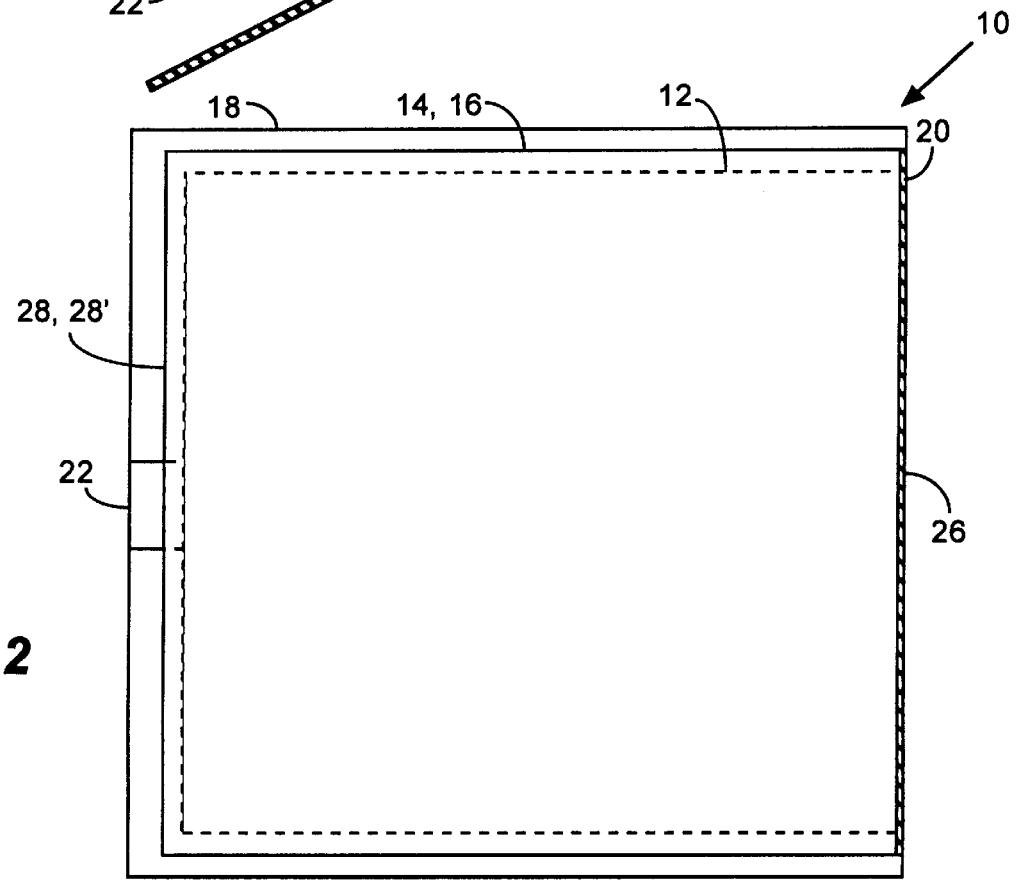
FIG. 2 is a top view of an embodiment of an inflatable pillow according to the invention.

FIG. 2 is a top view of the embodiment of an inflatable pillow of FIG. 1. The inflatable pillow 10 illustrated in FIG. 2 is shown as being generally rectangular in form. The seam 20 is shown as being generally straight along a straight first edge 26 of each of the airtight chamber 12, the first fabric sheet 14 and the second fabric sheet 16. The invention contemplates that an inflatable pillow may be realized in many shapes, including various polygons, circles and ellipses, and multi-sided shapes having combinations of straight and curved edges. Likewise, the seam may be formed along any appropriate first edge of the inflatable pillow, and the seam may be either straight or curved corresponding to the characteristics of the selected first edge.

Referring again to FIGS. 1 and 2, a securing tab 22 is affixed to and extends past a second edge 28 of the second fabric sheet 16. The securing tab 22 is used to join the first fabric sheet 14 and second fabric sheet 16 at their respective second edges 28, 28' in order to provide a comfortable fabric cover around the airtight chamber 12. In a preferred embodiment, the securing tab 22 is an adhesive tab. After the airtight chamber 12 has been inflated, the securing tab 22 is applied by simply wrapping the first fabric sheet 14 and second fabric sheet 16 respectively around the airtight chamber 12 and pressing the securing tab 22 against the second fabric sheet 16, causing the securing tab 22 to stick to the second fabric sheet 14. The securing tab may be adhesive on one side or on both sides, with the respective second edges 28, 28' of the first and second fabric sheets 14, 16 either joining end-to-end or overlapping, to attach the securing tab 22, as the case may be.

In another embodiment, the securing tab 22 may be formed of Velcro® (a registered trademark of Velcro Industries B.V.) or other suitable attachment means known to those of ordinary skill in the art. Also, in the embodiment illustrated in FIGS. 1 and 2, the inflatable pillow 10 includes only one securing tab 22. The invention contemplates that multiple securing tabs may be used along the respective second edges 28, 28' of the first and second fabric sheets 14, 16, and, if desired, along other edges if it is desired to secure the first and second fabric sheets 14, 16 along other edges of the inflatable pillow 10.

The invention also contemplates that the securing tab 22 may not extend past the second (or other) edge of the second fabric sheet 16, and that one of the first and second fabric sheets 14, 16 would overlap the other of the first and second fabric sheets 14, 16, thereby making contact with the securing tab 22.

While the securing tab 22 provides a convenient method of securing the first and second fabric sheets 14, 16 around the airtight chamber 12, the invention contemplates that there may be instances in which the securing tab 22 is not required, and, in such instances, the securing tab 22 may be omitted.

Referring again to FIGS. 1 and 2, the embodiment of an inflatable pillow 10 is illustrated as being rectangular in shape, with the airtight chamber 12 taking on a rectangular shape when viewed from above in a substantially inflated state. Likewise, the first and second fabric sheets 14, 16 are illustrated as being rectangular in shape, and having a length (measured from first edge to second edge) and width slightly larger than the corresponding length and width of the inflated airtight chamber 12. In preferred embodiments, the first and second fabric sheets 14, 16 have sufficient length to wrap around an entire inflated airtight chamber 12 and facilitate the use of the securing tab 22. In preferred embodiments, the first and second fabric sheets 14, 16 have sufficient width to cover substantially all of an inflated airtight chamber 12 so that the face, head and neck of a person using the inflatable pillow 10 come in contact only with the first and second fabric sheets 14, 16 and not in contact with the airtight chamber 12.

In preferred embodiments of such inflatable pillows of the invention, the shape and dimensions of the first and second fabric sheets 14, 16 correspond to that of the airtight chamber 12, with the first and second fabric sheets 14, 16 sized and configured to cover the inflated airtight chamber 12, thereby providing desired comfort and cleanliness to the user.

Referring again to FIGS. 1 and 2, in a preferred embodiment, the inflatable pillow 10 of the invention may also include a sanitary sheet 18, which is affixed to the exterior of the sandwich formed by the airtight chamber 12 and first and second fabric sheets 14, 16. The sanitary sheet 18 may be affixed by means of the seam 20 described above. The sanitary sheet 18 may be a perforated plastic material, or other suitable material. The sanitary sheet 18 may have substantially the same shape as the first and second fabric sheets 14, 16, and may have dimensions which are slightly larger than those of the first and second fabric sheets 14, 16 in order to provide a cover for the inflatable pillow 10 in an inflated state. The sanitary sheet 18 may help to keep the inflatable pillow 10 clean by insulating the inflatable pillow 10 from a seat, window, or other items upon which a user may place a pillow.

The sanitary sheet 18 may also be configured to serve as a protective cover for the inflatable pillow 10 in a deflated state. For example, the inflatable pillow 10 may be folded, rolled, or the like for shipping, for carrying by a user, and for storage. The sanitary sheet 18 may also have user information printed on it, e.g. instructions for inflation and use.

Note that in FIGS. 1 and 2 the sanitary sheet 18 is illustrated as being joined along the seam 20 exterior to the second fabric sheet 16, i.e. The fabric sheet to which the securing tab 22 is fixed. The invention contemplates that the sanitary sheet 18 may be joined to the inflatable pillow 10 outside either of the first or second fabric sheets 14, 16.

The inflatable pillow of the invention has a volume which is sufficiently small to allow the pillow be inflated by a human without the need for compressed air or other such methods. Inflation assemblies suitable for human inflatable devices, e.g., balls, water toys, air mattresses, and the like, are well known in the art. Such inflation assemblies (not illustrated in the FIGS.) typically include a small finger-like tube extending from an orifice in the airtight chamber. The airtight chamber is inflated by blowing air through the orifice via the tube, and then the tube is folded or rolled to prevent air from escaping, and the tube is pushed through the orifice into the airtight chamber to keep the tube in place in a sealed configuration.

The invention contemplates that such inflation assemblies may be used in embodiments of inflatable pillows. In addition, since it is intended that the inflatable pillow of the invention be disposable, and therefore low cost, in preferred embodiments inflatable pillow of the invention may include a somewhat simpler, and less expensive inflation assembly as illustrated in FIG. 3.

Figure 3:
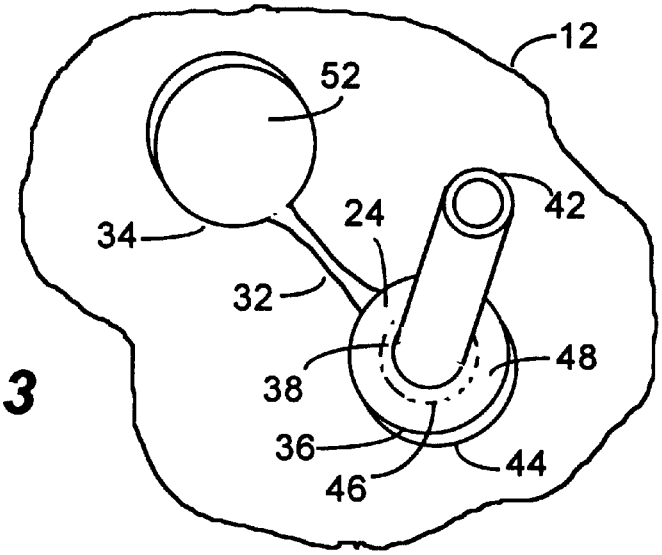
FIG. 3 is a perspective view of a preferred embodiment of an inflation assembly for a pillow according to the invention.

The inflation assembly 24 illustrated in FIG. 3 includes a small cylindrical tube 42 and a sealing strip 32. The sealing strip 32 includes a support section 36 and a sealing section 34. The support section 36 includes a first small orifice 38 which has substantially the same diameter as that of the cylindrical tube 42. The support section 36 has an adhesive underside 44, and a topside 48 which may optionally also be adhesive. The sealing section 34 has an adhesive bottomside 52. As illustrated in FIG. 3, the sealing strip 32 is a single strip including both the support and sealing sections 36, 34. However, the support section 36 and sealing section 34 need not be separate sections of a single strip, but rather may be separate strips of adhesive material. To receive the cylindrical tube 42, the airtight chamber 12 is pierced by a second small orifice 46, illustrated by a dashed line in FIG. 3, having a diameter substantially identical to that of the first small orifice 38.

To inflate the airtight chamber 12, the support section 36 of the sealing strip 32 is affixed to a section of the airtight chamber 12, by means of the adhesive underside 44, with the first and second small orifices 38, 46 aligned. The support strip 36 provides structural support around the aligned first and second small orifices 38, 46, helps to seal around the cylindrical tube 42 during inflation, and, after inflation, forms an airtight seal with adhesive bottomside 52 os the sealing section 34.

The cylindrical tube 42 is inserted through the aligned first and second small orifices 38, 46 forming an air path into the airtight chamber 12. Air is blown through the cylindrical tube 42 until the airtight chamber 12 is inflated. The cylindrical tube 42 is then temporarily pinched to prevent air from escaping, and the sealing section 34 of the sealing strip 32 is then pressed onto the support section 36, thereby forming an adhesive seal between the support section 36 and the sealing section 34, forcing the cylindrical tube 42 through both the first and second small orifices 38, 46 into the airtight chamber 12, and sealing the airtight chamber 12.

The inflatable pillow 10 may be deflated for disposal by separating the sealing section 34 from the support section 36, and optionally also removing the support section 36 from the airtight chamber, and allowing air to be expelled out the second small orifice 46.

Figure 4:
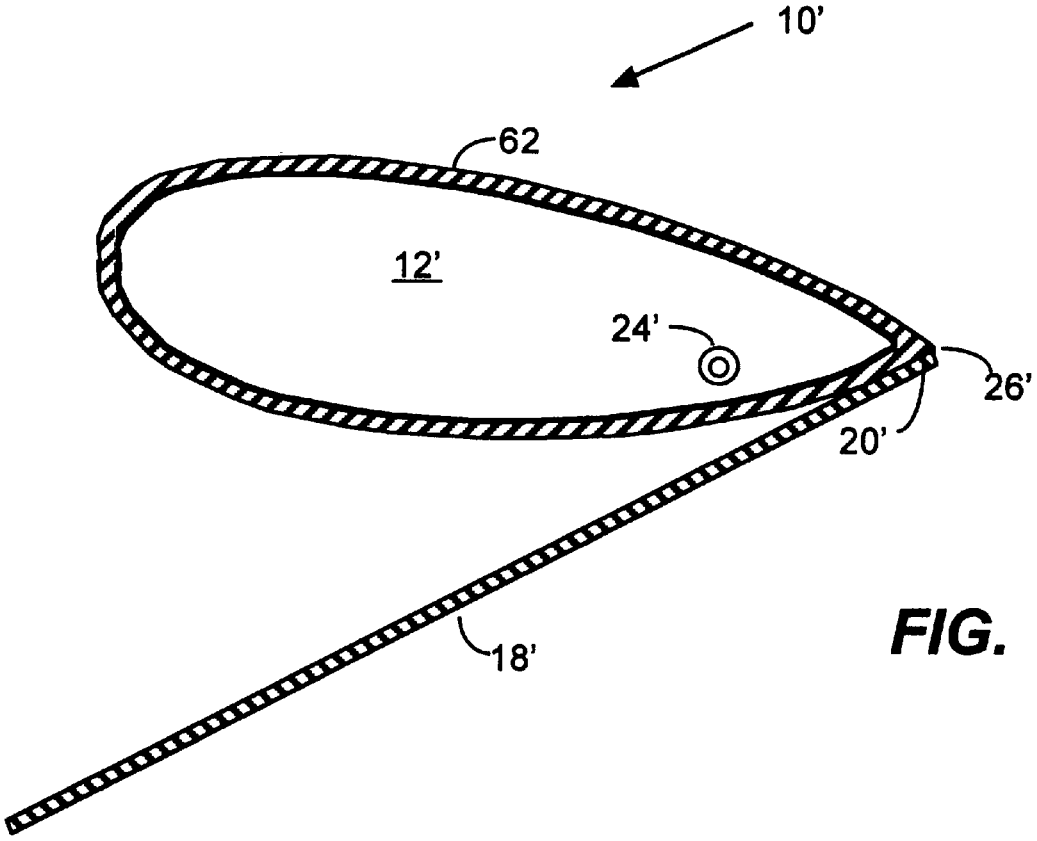
FIG. 4 is a side view of another embodiment of an inflatable pillow according to the invention.

FIG. 4 is a side view of another embodiment of the present invention. Those elements depicted in FIG. 4 that are common to the inflatable pillow 10 illustrated in FIG. 1 carry the same reference numeral distinguished by a prime ("') designation. In the embodiment depicted in FIG. 4, a one-piece, hollow fabric sleeve 62, which completely encircles the airtight chamber 12', replaces the first and second fabric sheets 14, 16, and also eliminates any need for the securing tab 22. The airtight chamber 12' and the fabric sleeve 62 are all joined at the seam 20' formed along the first edge 26' of the airtight chamber 12' and the fabric sleeve 62. The seam 20' may be formed by a heat sealing process, by interposing a double-sided adhesive strip (not illustrated in any of the FIGs) between the airtight chamber 12' and the fabric sleeve 62, by stitching, or by any other suitable process known to those of ordinary skill in the art.

It will be readily apparent to a person skilled in the art that numerous modifications and variations of the embodiments of the present invention are possible in light of the above teachings. It is therefore to be understood that, within the scope of the appended claims, the invention may be practiced other than as specifically described herein.

We claim:

1. An inflatable pillow comprising:

a first fabric sheet, a second fabric sheet, and an inflatable airtight chamber sandwiched between the first and second fabric sheets, the inflatable airtight chamber being joined to the first and second fabric sheets at a seam along only a first edge of each of the inflatable airtight chamber, the first fabric sheet and the second fabric sheet; the inflatable airtight chamber having a inflation assembly for regulating inflation and deflation of the inflatable airtight chamber; and the first and second fabric sheets being configured to wrap around and cover substantially all of the inflatable airtight chamber when the inflatable airtight chamber is substantially inflated.

2. An inflatable pillow according to claim 1 comprising securing means to secure the first fabric sheet to the second fabric sheet at a point distal from the respective first edges of each of the first and second fabric sheets.

3. An inflatable pillow according to claim 2 wherein the securing means comprises a securing tab.

4. An inflatable pillow according to claim 3 wherein the securing tab is an adhesive tab.

5. An inflatable pillow according to claim 1 further comprising a sanitary sheet joined to the sandwich of the first and second fabric sheets and inflatable airtight chamber exterior to one of the first and second fabric sheets, a first edge of the sanitary sheet joined to the sandwich along the seam.

6. An inflatable pillow according to claim 5, wherein the sanitary sheet comprises a perforated plastic material.

7. An inflatable pillow according to claim 1, wherein the inflation assembly comprises a small orifice in the airtight chamber, a cylindrical tube for blowing air through the orifice into the airtight chamber, and an adhesive strip for sealing the orifice.

8. An inflatable pillow comprising:

a one-piece, hollow fabric sleeve, and an inflatable airtight chamber enclosed within the fabric sleeve, the inflatable airtight chamber being joined to the fabric sleeve at a seam along only a first edge of each of the inflatable airtight chamber and the fabric sleeve; the inflatable airtight chamber having a inflation assembly for regulating inflation and deflation of the inflatable airtight chamber; and the fabric sleeve configured to encircle and cover substantially all of the inflatable airtight chamber when the inflatable airtight chamber is substantially inflated.

9. An inflatable pillow according to claim 8 further comprising a sanitary sheet joined to the hollow fabric sleeve exterior to the sleeve along the seam between the fabric sleeve and the airtight chamber.

10. An inflatable pillow according to claim 9, wherein the sanitary sheet comprises a perforated plastic material.

11. An inflatable pillow according to claim 8, wherein the inflation assembly comprises a small orifice in the airtight chamber, a cylindrical tube for blowing air through the orifice into the airtight chamber, and an adhesive strip for sealing the orifice.

* * * * *